United States Patent [19]

Hayashi

[11] Patent Number: 4,616,601

[45] Date of Patent: Oct. 14, 1986

[54] RADIATOR ANTI-FREEZE ARRANGEMENT FOR EVAPORATIVE TYPE COOLING SYSTEM

[75] Inventor: Yoshimasa Hayashi, Kamakura, Japan

[73] Assignee: Nissan Motor Co., Ltd., Yokohama, Japan

[21] Appl. No.: 754,980

[22] Filed: Jul. 15, 1985

[30] Foreign Application Priority Data

Jul. 16, 1984 [JP] Japan ..... 59-147400

[51] Int. Cl.[4] ..... F01P 3/22

[52] U.S. Cl. ..... 123/41.21; 123/41.27; 73/319

[58] Field of Search ..... 123/41.2–41.27; 165/41, 43; 340/623, 624; 73/319

[56] References Cited

U.S. PATENT DOCUMENTS 3,992,941 11/1976 McGoldrick ..... 73/319 X 4,549,505 10/1985 Hirano ..... 123/41.21

FOREIGN PATENT DOCUMENTS 124046 7/1984 European Pat. Off. ..... 123/41.21

121182 10/1984 European Pat. Off. ..... 123/41.21

*Primary Examiner*—William A. Cuchlinski, Jr.

*Attorney, Agent, or Firm*—Schwartz, Jeffery, Schwaab, Mack, Blumenthal & Evans

[57] ABSTRACT

In a boiling liquid cooling system of an engine, first and second coolant level sensors are disposed in a coolant jacket of the engine which respectively detect first and second coolant levels therein. The second coolant level is higher than the first coolant level. A control circuit employed in the invention functions so that when, with the coolant in the coolant jacket being at its boiling point, the coolant in the radiator is at a temperature higher than the freezing point of the coolant, the first level sensor becomes enabled disabling the second level sensor thereby to keep the coolant level in the coolant jacket at the first coolant level, while, when, with the coolant in the coolant jacket being at its boiling point, the coolant in the radiator comes to its freezing point or points around the same, the second level sensor becomes enabled disabling the first level sensor thereby to keep the coolant level in the coolant jacket at the second coolant level.

8 Claims, 3 Drawing Figures

RADIATOR ANTI-FREEZE ARRANGEMENT FOR EVAPORATIVE TYPE COOLING SYSTEM

BACKGROUND OF THE INVENTION

1. Field of the Invention

The present invention relates in general to an engine cooling system of the type wherein the coolant is boiled, so as to make use of the latent heat of vaporization thereof, and the coolant vapor used as vehicle removing heat from the engine, and more particularly to an improved arrangement of such system by which a radiator employed in the system is prevented from freezing even under very cold condition.

2. Description of the Prior art

Hitherto, a so-called "boiling liquid cooling system" (viz., evaporative cooling system) has been proposed for achieving cooling of an internal combustion engine. This type cooling system basically features an arrangmenet wherein a liquid coolant (for example, a mixture of water and antifreeze) in the coolant jacket of the engine is permitted to boil and the gaseous coolant thus produced is passed out to an air-cooled heat exchanger or radiator where the gaseous coolant is cooled or liquefied and then circulated back into the coolant jacket of the engine. Due to the effective heat exchange achieved between the gaseous coolant in the radiator and the atmosphere surrounding the radiator, the cooling system exhibits a very high performance.

However, as will become apparent as the description proceeds, some of the hitherto proposed cooling systems have suffered from the drawback that even when a mixture of water and antifreeze is used as the coolant, freezing of the coolant tends to occur in the radiator in cold seasons due to "localized coolant dilution phenomenon" occuring during operation of the system. Freezing of the coolant in the radiator deteriorates the performance of the cooling system and in a severer case, induces abnormally high pressure and thus abnormally high temperature in the coolant circulation system.

SUMMARY OF THE INVENTION

It is therefore an essential object of the present invention to provide an improved boiling liquid cooling system which can eliminate the above-mentioned undesirable phenomenon.

According to the present invention, there is provided a boiling liquid cooling system for an engine, which comprises means defining in the engine a coolant jacket into which coolant is introduced in liquid state through an inlet port formed in the engine and from which coolant is discharged in gaseous state through an outlet port formed in the engine, a radiator into which gaseous coolant from the outlet port is introduced to be liquefied, a coolant container connected to the radiator to contain therein the coolant liquefied by the radiator, an electric pump by which the liquid coolant in the coolant container is pumped into the coolant jacket through the inlet port, conduit means connecting the outlet port, the radiator, the coolant container, the electric pump and the inlet port in this order to form a hermetically closed coolant circulation circuit, first and second coolant level sensors disposed in the coolant jacket to detect first and second coolant levels in the coolant jacket respectively, the second coolant level being higher than the first coolant level, and control means for controlling the electric pump in such a manner that when, with the coolant in the coolant jacket being at its boiling point, the coolant in the radiator is at a temperature considerably higher than the freezing point of the coolant, the first level sensor becomes enabled disabling the second level sensor thereby to control the electric pump to keep the coolant level in the coolant jacket at the first coolant level, while, when, with the coolant in the coolant jacket being at its boiling point, the coolant in the radiator comes to its freezing point or points around the same, the second level sensor becomes enabled disabling the first level sensor thereby to control the electric pump to keep the coolant level in the coolant jacket at the second coolant level.

BRIEF DESCRIPTION OF THE DRAWINGS

Other objects and advantages of the present invention will become apparent from the following description when taken in conjuction with the accompanying drawings, in which.

DESCRIPTION OF PRIOR PROPOSED BOILING LIQUID COOLING SYSTEM

Prior to describing in detail the invention, a prior proposed boiling liquid cooling system will be described with reference to FIG. 3 because the present invention is closely associated with the cooling system.

Figure 3:
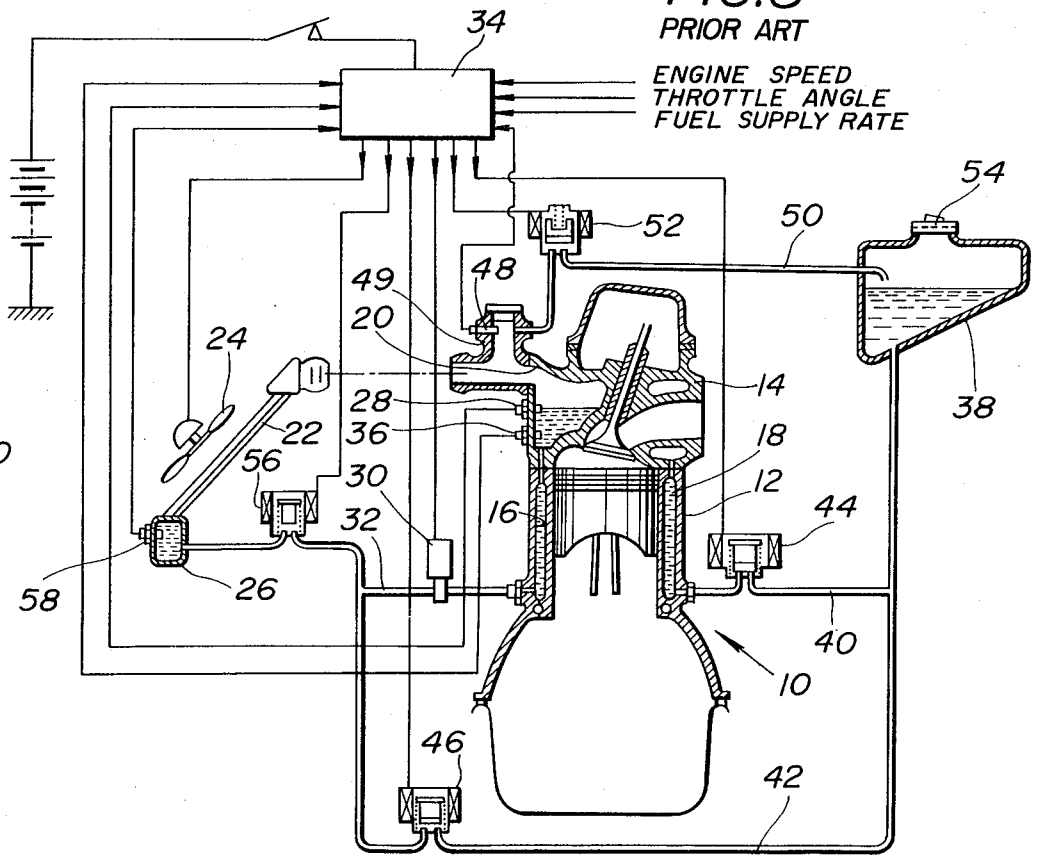
FIG.3 PRIOR ART
FIG. 3 is a schematical illustration of a boiling liquid cooling system which has been prior proposed.

In FIG. 3, there is shown the boiling liquid cooling system practically applied to an internal combustion engine, which is disclosed in prior filed U.S. patent application Ser. No. 663,911 filed Oct. 23, 1984 in the name of Yoshinori HIRANO now U.S. Pat. No. 4,549,505.

The engine is generally designated by reference 10 which includes a cylinder block 12 on which a cylinder head 14 is detachably mounted. The cylinder head 14 and the cylinder block 12 include suitable cavities which define a coolant jacket 16 about the heated portions of the cylinder head and block. Contained in the coolant jacket 16 is cooling liquid (coolant) 18 which, under normal operation of the system, sufficiently covers the walls of the combustion chambers while maintaining the upper portion of the coolant jacket 16 empty of the liquid coolant, as shown. The liquid coolant boils and evaporates when heated sufficiently by combustion heat of the engine, so that under normal operation of the engine, the upper portion of the jacket 16 is filled with coolant vapor.

Fluidly communicating with a vapor discharge port 20 of the cylinder head 14 is a radiator or heat exchanger 22. It is to be noted that the interior of this radiator 22 is maintained essentially empty of liquid coolant during normal engine operation so as to maximize the surface area available for condensing the coolant vapor (via heat exchange with the ambient atmosphere) and that the cooling system as a whole (viz., the system compassed by the coolant jacket, radiator and conduting interconnecting the same) is hermetically closed when the engine is warmed-up and running. These will become clearer as the description proceeds.

Located adjacent the radiator 22 is an electrically driven fan 24 which, upon energization, produces air flow passing through the radiator 22 to promote the condensation function of the same. Defined at the bottom of the radiator 22 is a small collection reservoir or lower tank 26 into which the coolant liquefied by the radiator 22 pours.

Disposed in the coolant jacket 16 is a coolant level sensor 28 which detects whether the level of the liquid coolant in the coolant jacket 16 is at a predetermined level or not. That is, when, due to the continuous evaporation in the jacket 16, the level of the liqiud coolant lowers to a level below the predetermined level, the signal issued from the sensor 28 induces energization of an electrically driven pump 30 which is disposed in a return passage 32 which extends from the lower tank 26 of the radiator 22 to a lower portion of the coolant jacket 16 of the engine 10. Upon energization of the pump 30, the liquid coolant is introduced into the coolant jacket 16 from the lower tank 26. Actually, the operation of the pump 30 is controlled by a control unit 34 which is described in detail in the afore-mentioned prior filed U.S. Patent Application. With this, the coolant level in the coolant jacket 16 is kept substantially at the predetermined level during normal operation of the system.

A temperature sensor 36 is disposed also in the coolant jacket 16 in order to detect the temperature of the coolant therein. Receiving signals from the temperature sensor 36 and other sensors (not shown), such as, engine speed sensor, throttle valve angle sensor and fuel supply rate sensor, the control unit 34 controls operation of the electric fan 24 in a manner to allow the engine proper 10 to have an optimum temperature in accordance with the operation mode thereof. Under operation of the cooling system, the cooling system as a whole is hermetically closed, so that changing the pressure in the system induces variation in the boiling point of the liquid coolant contained therein.

When, for example, the engine 10 is under low load condition wherein heat generated by the engine is relatively small, the control unit 34 controls the electric fan 24 to produce a less amount of air flow per unit time (in practice, the control unit 34 stops the fan 24) to lower the condensation function of the radiator 22. With this, the pressure in the system becomes higher than the atmospheric value thereby increasing the boiling point of the liquid coolant in the system to a certain value, so that the temperature of the coolant in the coolant jacket 16 can be kept at relatively high level (for example, 120° C.) thereby achieving reduction in thermal loss of the engine 10.

When, on the contrary, the engine is under high load condition wherein heat generated by the engine is great, the control unit 34 controls the electric fan 24 to produce a greater amount of air flow per unit time (in practice, the control unit 34 continues energization of the electric fan 23) to promote the condensation function of the radiator 22. With this, the pressure in the system becomes lower than the atmospheric value thereby lowering the boiling point of the coolant in the system, so that the temperature of the coolant in the coolant jacket 16 can be kept at relatively low level (for example 90° C.) thereby achieving appropriate cooling of the engine.

Since the latent heat of the coolant 18 is considerably high and the heat radiation of the coolant vapor at the radiator 22 is sufficiently high, cooling of the engine 10 can be effectively achieved with a small amount of liquid coolant. Furthermore, by the reasons as mentioned hereinabove, the temperature control of the engine 10 can be effected in accordance with the operation modes of the engine with quick response.

In order to deal with undesirable negative pressure in the system which might occur when, after stop of the engine, the temperature of the liquid coolant lowers to the atmospheric value, the following measure is employed. (Actually, lowering of the coolant temperature promotes liquefaction of the coolant vapor in the system and thus the pressure therein is reduced considerably).

A reservoir tank 38 is provided which is connected with the coolant jacket 16 of the engine 10 through conduits 40 and 42. Electromagnetic valves 44 and 46 are disposed in the conduits 40 and 42, respectively. The control unit 34 functions so that, upon stop of the engine 10, it opens the valve 44 thereby forcing additional liquid coolant in the reservoir tank 38 to flow down to the coolant jacket 16 by the force mainly produced by the pressure difference between the interior of the system and the atmosphere. This coolant supply is continued until the level of the coolant in the jacket 16 rises to the level of another coolant level sensor 48 which is disposed in a riser-like portion 49 of the cylinder head 14, as shown. With this, the negative pressure in the system disappears.

In order to deal with undesirable air-contamination in the system which might occur when, due to lowering in pressure in the system, atmospheric air invades or enters the coolant jacket 16 of the engine through any incompletely sealed portion of the system, the following measure is also employed.

A conduit 50 extends from the riser-like portion of the cylinder head 14 to the reservoir tank 38 and an electromagnetic valve 52 is disposed in the conduit 50. The control unit 34 functions so that upon starting of the engine 10, it opens the valves 52 and 46 and energizes the pump 30 thereby forcing the additional liquid coolant in the reservoir tank 38 to flow into the coolant jacket 16 until the level of the liquid coolant comes to the level of the level sensor 48. During this operation, the contaminating air in the coolant jacket 16 is driven into the reservoir tank 38 through the conduit 50 and discharged to the atmosphere through an air permeable cap 54 of the reservoir tank 38. During this, the valve 44 and another electromagnetic valve 56 which is disposed in the return conduit 32 are both closed.

When, with the contaminating air thus discharged, the temperature of the liquid coolant in the coolant jacket 16 increases to a certain degree, the coolant in the jacket 16 starts boiling. Upon this, the valve 44 in the conduit 40 is opened in response to information signals applied thereto from a liquid level sensor 58 which is mounted to the lower tank 26 of the radiator 22, so that the coolant in the jacket 16 is obliged to boil under atmospheric pressure causing the coolant in the jacket 16, by the amount corresponding to that additionally fed to the jacket 16 from the reservoir tank 38 for the air purging, to return back to the reservoir tank 38. This coolant return operation is mainly carried out by the pressure produced in the vapor space of the coolant jacket 16.

As is described in the afore-mentioned prior filed U.S. Application, the pump 30 is controlled by the level sensor 28 so as to keep the level of the liquid coolant in the coolant jacket 16 at the predetermined degree. When, however, the liquid coolant level in the lower tank 26 of the radiator 22 lowers to the level determined by the level sensor 58 mounted thereto, operation of the pump 30 stops irrespective of nature of the signals issued from the level sensor 28 of the coolant jacket 16.

With the arrangement and operation described hereinabove, the boiling liquid cooling system can exhibit its excellent cooling performance over wide operation modes of the engine 10. Since the cooling work of the system can be expected with a small amount of liquid coolant, the sizes or capacities of the coolant jacket 16, the radiator 22 and the electric pump 30 can be reduced, which induces "small-sized and light-weight" construction of the cooling system. Furthermore, warm up of the engine 10 can be effected in a shortened time and, due to the excellent heat exchange carried out at the radiator 22, operation of the electric fan 24 can be economized. That is, the time for which the fan 24 operates practically can be shortened.

DRAWBACKS ENCOUNTERED IN THE PRIOR PROPOSED SYSTEM

However, the boiling liquid cooling system as mentioned hereinabove has suffered from the following drawback that even when a mixture of water and anti-freeze (viz., ethylene glycol) is used as the coolant, freezing of the coolant tends to occur in the radiator 22 particularly in cold season. That is, due to the difference in boiling point between water and the anti-freeze, only water vapor tends to be produced in the coolant jacket 16 and introduced into the radiator 22 during operation of the engine thus causing the anti-freeze (ethylene glycol) to concentrate in the coolant jacket 16. Thus, with a passage of time, the concentration of anti-freeze in the coolant jacket 16 is gradually increased while that in the lower tank 26 of the radiator 22 gradually reduces. That is to say, via a "distillation" process the coolant contained in the lower tank tends to become diluted to the point of being only water while the anti-freeze tends to concentrate in the coolant jacket. Accordingly, even during operation of the engine, the water in the lower tank 26 due to the very low concentration of anti-freeze readily freezes in cold weather despite the fact that anti-freeze has been deliberately added to the coolant. Of course, this phenomenon deteriorates the performance of the cooling system, and in a severer case, induces abnormally high pressure and thus abnormally high temperature in the coolant jacket 16 of the engine 10.

DETAILED DESCRIPTION OF THE INVENTION

In order to eliminate the above-mentioned undesirable phenomenon, an improvement is made in the boiling liquid cooling system according to the present invention, which will be described hereinnext.

Figure 1:
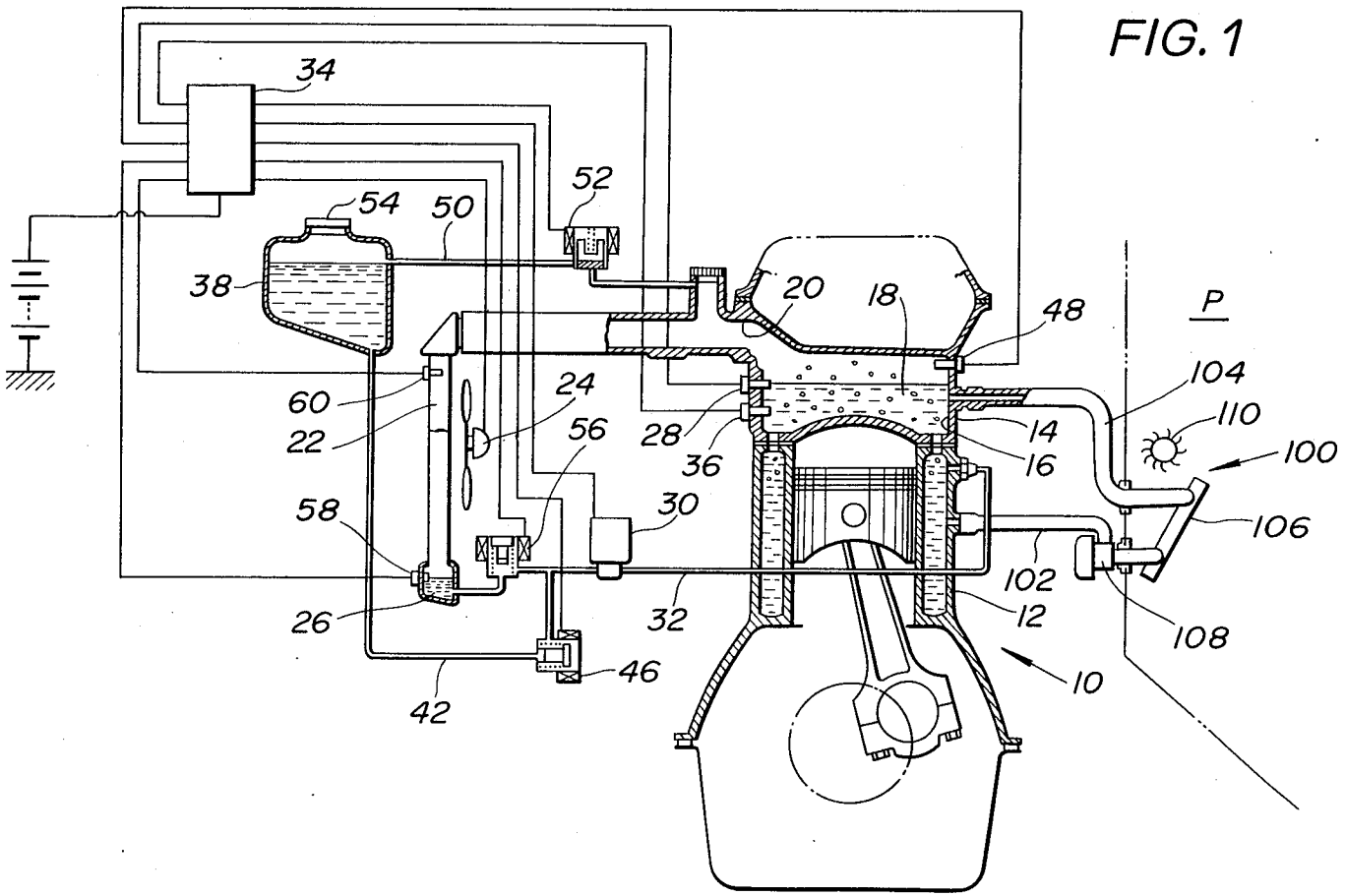
FIG. 1 is a schematical illustration of a boiling liquid cooling system of an internal combustion engine, to which the present invention is practically applied.
Figure 2:
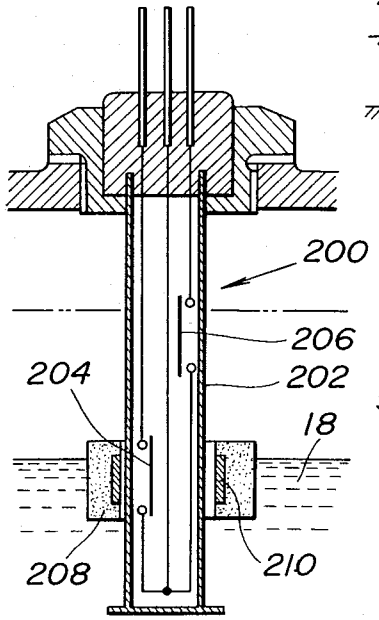
FIG. 2 is a sectional view of a liquid level sensor unit which is usable in the present invention.

Referring to FIGS. 1 and 2, particularly FIG. 1, there is shown the improved boiling liquid cooling system of the present invention, which is practically applied to an internal combustion engine. For facilitation, substantially the same parts and constructions as those in the afore-mentioned prior proposed system (FIG. 3) are designated by the same numerals and detailed explanation of them will be omitted from the following description.

The engine 10 includes a cylinder block 12 and a cylinder head 14 which are assembled together and have therein a coolant jacket 16 in which cooling liquid (coolant) 18 is contained.

Designated by reference 100 is a passenger heating system which warms the passenger compartment by using warmed coolant 18 in the coolant jacket 16 of the engine 10 as heat source. The heating system 100 comprises two tubes 102 and 104 between which is interposed a heater core 106 which is exposed to the passenger compartment P. These tubes 102 and 104 are connected to the lower and upper portions of the coolant jackets 16, as shown. An electric pump 108 is disposed in the tube 102 to make a coolant flow in the system. An electric fan 110 is arranged adjacent the heater core 106 to produce air flow passing through the heater core 106.

The cylinder head 14 has a vapor discharge port 20 which is connected to a radiator or heat exchanger 22. An electric fan 24 is located adjacent the radiator 22 for producing cooling air flow passing through the radiator 22. The radiator 22 has a lower tank 26 into which the coolant liquedfied by the radiator proper pours. A liquid coolant passage 32 extends from the lower tank 26 to a middle portion of the coolant jacket 16. An electric pump 30 is disposed in the coolant passage 32. A first coolant level sensor 28, a second coolant level sensor 48 and a temperature sensor 36 are disposed in the coolant jacket 16, and another coolant level sensor 58 is disposed in the lower tank 26 of the radiator 22. It is to be noted that the second level sensor 48 is positioned above the first level sensor 28 so as to detect the coolant level higher than that determined by the first level sensor 28.

FIG. 2 shows a level sensor unit of float type, which is usable as a substitute for the separately arrangd first and second level sensors 28 and 48. The sensor unit 200 comprises a tubular holder 202 vertically extending in the coolant jacket 16 in the cylinder head 14. Within the tubular holder 202, there are arranged two magnetically operable reed switches 204 and 206 at vertically different portions, as shown. An annular float 208 is axially movably disposed about the holder 202, and a magnet 210 is mounted to the float 208 to move therewith. When, due to lowering or rising of the coolant level in the coolant jacket 16, the float 208 comes to the positions of these switches 204 and 206, these switches are brought into ON (closed) positions, selectively.

A reservoir tank 38 is provided which is connected to the coolant passage 32 through a conduit 42. An electromagnetic valve 46 is disposed in the conduit 42. Another electromagnetic valve 56 is dispose2 through a conduit 42. An electromagnetic valve 46 is disposed in the conduit 42. Another electromagnetic valve 56 is disposed in the coolant passage 32 at the position between the lower tank 26 of the radiator 22 and the joint portion (no numeral) between the coolant passage 32 and the conduit 42. An air permeable cap 54 is detachably fitted to the reservoir tank 38.

A conduit 50 extends from the riser-like portion of the vapor discharge port 20 of the cylinder head 14 to the reservoir tank 38 and an electromagnetic valve 52 is disposed in the conduit 50.

Another temperature sensor 60 is disposed in an upper portion of the radiator 22 to detect the temperature of the coolant in the radiator 22.

A control unit 34 employed in the invention functions as follows:

Although not shown in the drawing, like in the above-mentioned prior proposed system of FIG. 3, information signals issued from engine speed sensor, throttle valve angle sensor and fuel supply rate sensor are applied to the control unit 34 in addition to those issued from the sensors 28, 36, 48 and 58 shown in the drawing.

Under normal operation of the system, similar operation to that of the above-metnioned prior proposed system of FIG. 3 takes place. That is, in this normal condition, the elecric fan 24 is controlled in accordance with the engine load, the electromagnetic valve 56 is opened and in accordance with the signals from the coolant level sensor 28, the electric pump 30 is controlled to flow the liquid coolant in the lower tank 26 of the radiator 22 toward the coolant jacket 16 while keeping the coolant level in the coolant jacket 16 at a predetermined level.

When, during this operation, with the coolant 18 in the coolant jacket 16 being at its boiling point, the coolant in the radiator 22 comes to its freezing point or points around the same (these temperatures are detected by the temperature sensors 36 and 60 respectively), the coolant level sensor 28 becomes disabled and therefor the other coolant level sensor 48 becomes enabled in order to raise, by the aid of the electric pump 30, the coolant level in the jacket 16 to a new level determined by the upper level sensor 48. Thereafter, the electric pump 30 is controlled in accordance with the signal from the sensor 48 so as to keep the coolant level at the newly determined level.

When, however, the coolant in the coolant jacket 16 is below the boiling point thereof and the coolant in the radiator 22 is at its freezing point or points around the same, the electromagnetic valve 46 is opened so as to introduce the coolant from the reservoir tank 38 into the coolant jacket 16. When, thereafter, the coolant 18 in the coolant jacket 16 comes to its boiling point, the electromagnetic valve 46 is closed.

Advantageous operation achieved from the above-mentioned improved cooling system will be described with respect to a condition wherein a mixture of water and antifreeze (ethylene glycol) is used as the coolant.

As is described hereinabove, under operation of the system, only water vapor tends to be introduced into the radiator 22 from the coolant jacket 16 causing the coolant in the lower tank 26 to be diluted. When, with the coolant in the coolant jacket 16 being at its boiling point, the coolant in the radiator 22 comes to its freezing point or points around the same due to for example cold weather, the upper coolant level sensor 48 becomes enabled disabling the lower coolant level sensor 28 so that the coolant level in the coolant jacket 16 is raised to the newly determined level (the level determined by the sensor 48) by the work of the pump 30. Thus, thereafter, the upper coolant level sensor 48 controls the pump 30 so as to keep the coolant level at the newly determined level.

Under this condition, the boiling coolant (viz., highly heated liquid coolant) jumping up in the coolant jacket 16 flows easily into the cold radiator 22 through the vapor discharge port 20, so that the radiator 22 and thus the lower tank 26 thereof are quickly heated. Thus, the undesirable coolant freezing in the radiator 22 is eliminated.

When, however, with the coolant in the coolant jacket 16 being at a point below its boiling point, the coolant in the radiator 22 comes to its freezing point or points around the same, the above-mentioned level raising operation does not occur in the coolant jacket 16. Thus, in this condition, the heated liquid flow into the radiator 22 does not occur. However, in this condition, the interior of the system becomes negative in pressure and the electromagnetic valve 46 is opened, so that the coolant is introduced from the reservoir tank 38 into the system including the radiator 22. Accordingly, the temperature in the radiator 22 is somewhat warmed thereby preventing the coolant in the radiator 22 from freezing. (It is thus necessary to locate the reservoir tank 38 at a somewhat warmed portion in the vehicle so as to prevent the coolant in the tank 38 from freezing.) When thereafter the coolant in the coolant jacket 16 starts boiling, the additionally fed coolant in the system is forced to return back to the reservoir tank 38 by the vapor pressure produced in the coolant jacket 16 allowing the system to operate normally.

As is described hereinabove, in accordance with the present invention, even when, due to cold weather, the coolant in the radiator comes to its freezing point or points around the same during operation of the system, the highly heated liquid coolant is forced to flow into the radiator through the vapor discharge port of the cylinder head. Thus, the undesirable coolant freezing in the radiator is avoided unlike the case of the afore-mentioned prior proposed system.

What is claimed is:

1. A boiling liquid cooling system for an engine, comprising:

means defining in the engine a coolant jacket into which coolant is introduced in liquid state through an inlet port formed in the engine and from which coolant is discharged in gaseous state through an outlet port formed in the engine;

a radiator into which gaseous coolant from said outlet port is introduced to be liquefied;

a coolant container connected to said radiator to contain therein the coolant liquefied by said radiator;

an electric pump by which the liquid coolant in said coolant container is pumped into said coolant jacket through said inlet port;

conduit means connecting said outlet port, said radiator, said coolant container, said electric pump and said inlet port in this order to form a hermetically closed coolant circulation circuit;

first and second coolant level sensors disposed in said coolant jacket to detect first and second coolant levels in the jacket respectively, said second coolant level being higher than said first coolant level; and control means for controlling said electric pump in such a manner that when, with the coolant in the coolant jacket being at its boiling point, the coolant in the radiator is at a temperature higher than the freezing point of the coolant, said first level sensor becomes enabled disabling said second level sensor thereby to control said electric pump to keep the coolant level in said coolant jacket at said first coolant level, while, when, with the coolant in the coolant jacket being at its boiling point, the coolant in the radiator comes to its freezing point or points around the same, said second level sensor becomes enabled disabling said first level sensor thereby to control electric pump to keep the coolant level in said coolant jacket at said second coolant level.

2. A boiling liquid cooling system as claimed in claim 1, in which said control means comprises first and second temperature sensors which are respectively disposed in said coolant jacket and said radiator to detect the temperatures of coolant in them.

3. A boiling liquid cooling system as claimed in claim 2, further comprising a reservoir tank in which additional liquid coolant is contained, said reservoir tank being connected through a conduit to said conduit means at the position between said coolant container and said electric pump.

4. A boiling liquid cooling system as claimed in claim 3, further comprising an electromagnetic valve which is disposed in said conduit, said valve being opened when, with the coolant in the coolant jacket being at a temperature below its boiling point, the coolant in the radiator comes to its freezing point or points around the same.

5. A boiling liquid cooling system as claimed in claim 4, further comprising a third coolant level sensor which is disposed in said coolant container to detect the coolant level therein.

6. A boiling liquid cooling system as claimed in claim 5, further comprising an electric fan which is positioned adjacent said radiator to produce air flow which passes through said radiator to promote the function of the radiator.

7. A boiling liquid cooling system as claimed in claim 6, further comprsing a passenger heating system which comprises:

a heater core which is adapted to be exposed to the passenger compartment;

two tubes between which said heater core is interposed, said tubes being connected to upper and lower portions of said coolant jacket;

an electric pump disposed in one of the tubes to produce a coolant flow in the tubes and said heater core when energized.

8. A boiling liquid cooling system as claimed in claim 1, in which a float type level sensor is employed as a substitute for the first and second level sensors, said float type level sensor comprising:

a tubular holder vertically extending in said coolant jacket;

first and second magnetically operable reed switches disposed in said tubular holder at vertically different portions therein;

a float movable along said tubular holder in response to rising and lowering of coolant level in said coolant jacket; and a magnet fixed to said float to move therewith.

* * * * *